US005794317A

United States Patent [19]

Allison

[11] Patent Number: 5,794,317

[45] Date of Patent: Aug. 18, 1998

[54] NON-MARKING SPREADER FOR TUBULAR KNITTED FABRIC

[75] Inventor: Earl Scott Allison, Kannapolis, N.C.

[73] Assignee: Tubular Textile LLC, Lexington, N.C.

[21] Appl. No.: 716,941

[22] Filed: Sep. 20, 1996

Related U.S. Application Data

[60] Provisional application No. 60/004,872 Oct. 4, 1995.

[51] Int. Cl.[6] ..... D06C 5/00

[52] U.S. Cl. ..... 26/80; 26/84

[58] Field of Search ..... 26/80, 82, 83, 26/84, 85, DIG. 1

[56] References Cited

U.S. PATENT DOCUMENTS

| | | | |
|---|---|---|---|
| 2,294,642 | 9/1942 | Wedler . | |
| 2,590,938 | 4/1952 | Cohn et al. | 26/84 |
| 2,623,264 | 12/1952 | Dungler . | |
| 3,175,272 | 3/1965 | Cohn et al. | 26/84 |
| 3,616,502 | 11/1971 | Aronoff | 26/85 |
| 3,762,003 | 10/1973 | Frezza | 26/81 |
| 3,811,159 | 5/1974 | Cecere | 26/84 |
| 3,875,624 | 4/1975 | Frezza | 26/84 |
| 3,882,577 | 5/1975 | Aronoff | 26/84 |
| 3,973,304 | 8/1976 | Catalo | 26/84 |
| 3,973,305 | 8/1976 | Catallo | 26/81 |
| 4,103,402 | 8/1978 | Frezza | 26/84 |
| 4,173,812 | 11/1979 | Cecere | 26/84 |

FOREIGN PATENT DOCUMENTS

| | | | |
|---|---|---|---|
| 419158 | 5/1966 | Japan | 26/83 |
| 5039186 | 12/1975 | Japan | 26/83 |

*Primary Examiner*—Amy B. Vanatta

*Attorney, Agent, or Firm*—Schweitzer Cornman Gross & Bondell LLP

[57] ABSTRACT

A spreader-propeller apparatus for processing of tubular knitted fabric. Each of two spaced-apart frame sections is formed of upper and lower sheet metal sections mounting a plurality of grooved guide rollers carrying fabric-engaging propeller belts. The frame structure supports entry-side and exit-side belts which, in the mid-regions of the frame structure, are trained about vertically extended substantially cylindrical driving rolls. Smooth surfaced, large diameter tubular structural elements are rigidly secured above and below the sheet metal frame sections and are transitionally contoured in bridging portions to extend at least slightly above and slightly below the vertically extending drive rollers. The geometry of the sheet metal frame sections and the smooth wall tubing secured thereto is such that tubular knitted fabric being processed on the spreader is at all times guided away from and held in spaced relation to fixed surfaces presenting an edge or corner. At the discharge end of the spreader, the fabric passes over tapered guide rollers, avoiding contact of the fabric with a stationary edge, as the fabric exits from the spreader.

14 Claims, 5 Drawing Sheets

NON-MARKING SPREADER FOR TUBULAR KNITTED FABRIC

This application claims priority of provisional application Ser. No 06/004,872, filed Oct. 4, 1995.

BACKGROUND AND SUMMARY OF THE INVENTION

In the processing of tubular knitted fabric, one of the steps involved in the finishing of the fabric is the spreading of the fabric to flat, two-layer form accompanied by lateral distension of the fabric to a desired, predetermined width. For this purpose, it is conventional to utilize an adjustable width spreader frame that is received internally of the tubular fabric and guides and drives the fabric forwardly while distending it widthwise. One typical form of such spreader apparatus is illustrated in the Frezza U.S. Pat. No. 4,103,402, in which spaced-apart side frame structures, mounting entry side and exit side belts for advancing the fabric, are arranged to be both supported between and driven by grooved edge drive rollers. While the spreader frame itself is received internally of the fabric tube, the edge drive rolls are external and serve to both drive and support the spreader frame through an intervening wall of fabric material. In another typical form of spreader apparatus, illustrated in the Cecere U.S. Pat. No. 3,811,159, edge drive rolls are of cylindrical form, serving to drive propeller belts through an intervening wall of fabric and locating the spreader frame in a fore and aft direction, while separate support rollers are provided in underlying relation to the spreader frame to support it vertically.

The design of spreader-propeller apparatus for tubular knitted fabric has continually, but without complete success, focused on the problem of processing the fabric to achieve the desired increase in width, without at the same time subjecting the fabric to longitudinal marking, in such a way as to impair appearance and quality of the fabric. In this respect, the fabric passing over the spreader frame can be under considerable circumferential tension, and it typically is both warm and moist and thus in a somewhat delicate condition, and is thus easily marked by rubbing contact with metal edges and corners.

In accordance with the present invention, a spreader-propeller apparatus is provided which, while providing the advantageous functional characteristics of known spreader designs, is so designed and constructed that fabric passing over the spreader is prevented from having rubbing or sliding contact with any surfaces that define or form an edge or small radius corner. The arrangement is such that, as the distended tubular fabric is advanced along the spreader frame, it is contacted either by surfaces that are in motion with the fabric or, where the surfaces are stationary, by smooth, generously rounded surface areas which effectively prevent concentrated pressure contact between the fabric and the stationary surfaces.

Because of the desire to minimize both weight and cross sectional profile spreader frames desirably utilize sheet metal elements to form entry and exit sections in which belt-carrying guide rollers are journalled. In the apparatus of the invention, not only the sheet metal structure, but also mounting bolts by which the various guide rollers are journalled, are effectively removed from the path of fabric travel, so that the only stationary surfaces encountered by the moving fabric are large radius surfaces of stainless steel tubing of substantial (e.g. ¾ of an inch) diameter, presenting only generously rounded surfaces to the fabric and, even there, to the extent practicable, minimizing the angle formed by the fabric on opposite sides of its contact area with the tubing, so that pressure of the fabric against the tubing is minimized.

A significant additional advantage of the new spreader construction is that the tubular structural elements employed therein provide significant added strength and durability to the spreader structure. In this respect, because of occasional holes and other discontinuities in the processed fabric, spreading devices occasionally become tangled with the incoming fabric, which can easily bend or otherwise damage the spreader frame before the processing line can be halted, whether automatically or by operator control. In a continuously running line, this may happen as often as once an hour, so that maintenance of conventional spreader devices is constantly required. The device of the present invention is significantly less subject to damage of this kind, because of its inherently greater strength, so that less maintenance is required and fewer spare parts need to be kept in readiness.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figure 1:
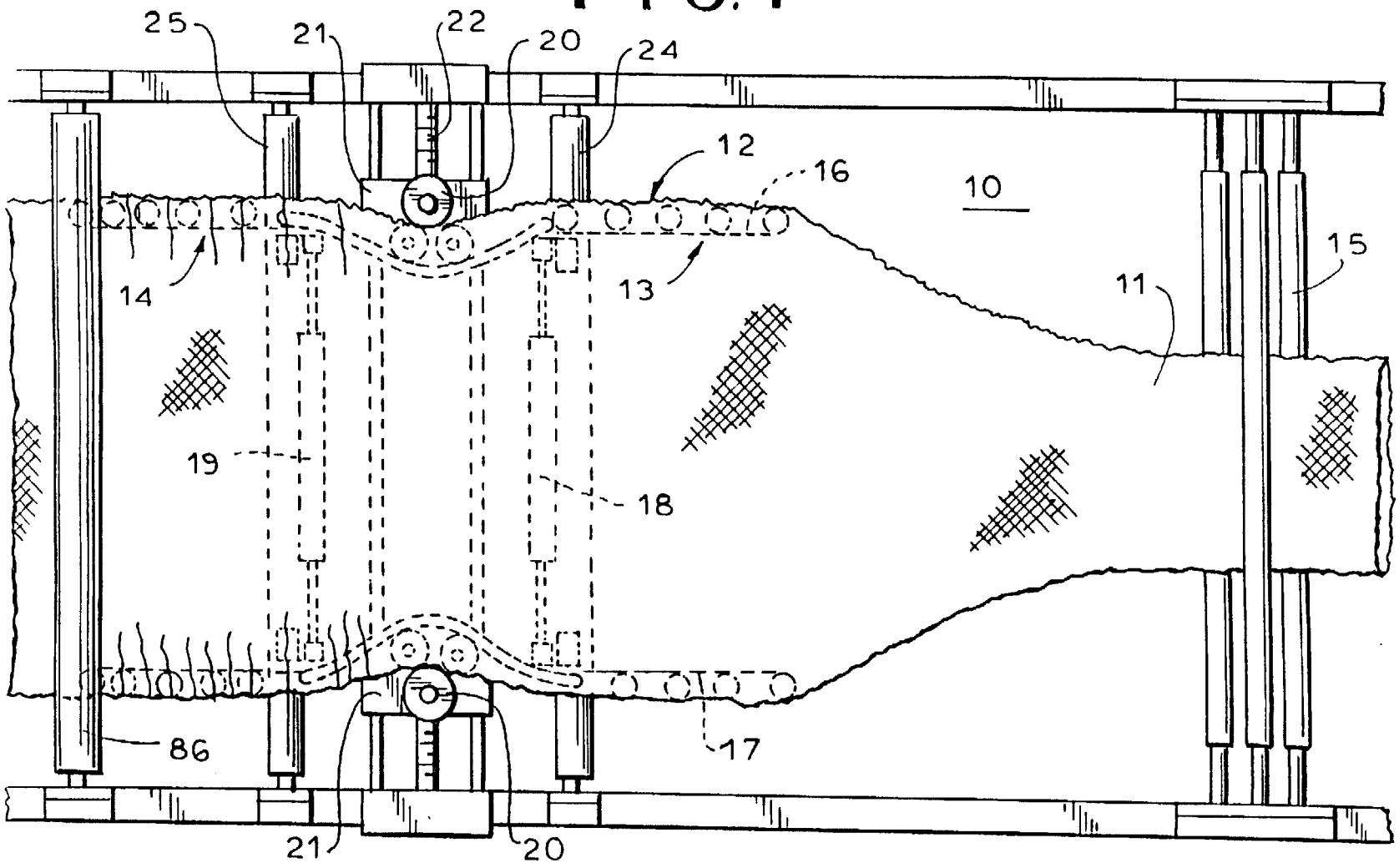
FIG. 1 is a top plan view of a portion of a finishing line, incorporating the spreader mechanism of the invention.

Referring now to the drawings, the reference numeral 10 designates generally a portion of a fabric finishing line for performing some or all of the finishing operations associated with the processing of tubular knitted fabric. After typical preliminary processing, tubular knitted fabric 11 is both elongated and narrowed relative to its "normal" geometry, and is caused to pass over a spreader frame 12 to at least partially restore its original condition. The fabric conventionally is conveyed by internal belts, to be described, which advance the fabric over an entry end of the spreader at a slightly greater speed than the speed at which the fabric is discharged from the exit end of the spreader. This allows for readjustment of fabric geometry to accommodate the change in length that results from lateral distension and assures that the fabric discharged from the spreader is in a generally longitudinally relaxed condition. Typically, the fabric is steamed while passing over the spreader frame.

In a typical spreader system, the incoming fabric 11 is passed through a series of offset rollers 15, which apply a light tensioning to the fabric and enable it to approach the spreader frame 12 in a controlled and flattened manner. The spreader frame 12, which consists of spaced-apart side frame assemblies 16, 17 at opposite sides, is set to a desired width by internal spacer rods 18, 19, which are either adjustable in length or are of a chosen length, to hold the two spreader side frames 16, 17 at the desired distance apart.

The illustrated spreader frame is supported and positioned horizontally by means of transversely disposed support rollers 24, 25, located on opposite sides of the edge drive rolls 20 and arranged to support the entire weight of the spreader frame and the fabric passing thereover. The spreader frame is located and driven by external edge drive rolls 20 mounted on movable carriages 21 adjustably positioned by a threaded shaft 22. When the edge drive rolls 20 are brought into contacting relation with internal belt-driving rollers 26, 27, through an intervening wall of fabric, the spreader frame is locked in position in a fore and aft (longitudinal) direction.

Each of the side frame assemblies 16, 17 comprises an entry end section 13 and an exit-end section 14. The respective frame sections 13, 14 each include a plurality of grooved guide rollers 28 which guide entry end and exit end belts 29, 30. The belts 29, 30 are trained about the respective belt driving rollers 26, 27 and, in accordance with known principles, the rollers 26, 27 are grooved to different depths to receive the respective belts 29, 30 such that the exit end belts 30 travel at a slightly reduced rate of speed relative to the entry end belts 29.

In the illustrated form of the invention, the entry end and exit end frame sections 13, 14 are formed in part by upper and lower sheet metal strips 31, 32, for the entry end, and 33, 34, for the exit end. In a preferred embodiment of the invention, these may be formed of flat, stainless steel sheet metal of about sixteen gauge thickness and about 1.5. inches in width. At spaced intervals along the frame sections, the stainless steel strips journal the grooved guide rollers 28 which, in a representative embodiment, may have a diameter of about two inches and a thickness of about ⅝ inch. The guide rollers 28 are journalled by means of bolts 35, which extend through the upper and lower sheet metal strips and are of a low profile design so as to have a relatively minimum projection above the upper sheet metal strips and below the lower strip metal sheets.

The exit-end frame sections 14 of the illustrated structure are of straight construction, whereas the entry end frame sections 13 preferably are angled slightly inward at their upstream extremities to facilitate entry of the fabric 11 over the entry end of the frame. Additionally, the first guide rollers 36, at the upstream extremity of the entry end frame sections 13, advantageously are of larger diameter, for example approximately 2⅞ inches, which also facilitates the initial entry of the fabric onto the spreader frame.

Pursuant to one aspect of the invention, the frame sections 13, 14 incorporate upper and lower tubular sections 37, 38 and 39, 40. These are rigidly secured to the sheet metal strips 31–34, advantageously by welding at a plurality of locations 41. In a preferred embodiment of the invention, the tubular elements 37–40 are formed of stainless steel tubing of about ¾ inch diameter. At the entry and exit extremities of the frame sections, the sections of tubing are merged gradually into the flat surfaces of the sheet metal strips 31–34, as reflected at 42, 43 in FIG. 3. As shown in FIGS. 4–8, the tubular elements 37–40 are disposed along inner longitudinal edge portions of the respective sheet metal strips 31–34. The various guide roller journalling bolts 35 are located laterally outward of the tubular elements 37–40, so as to provide access to the bolts for removal and replacement.

Figure 4:
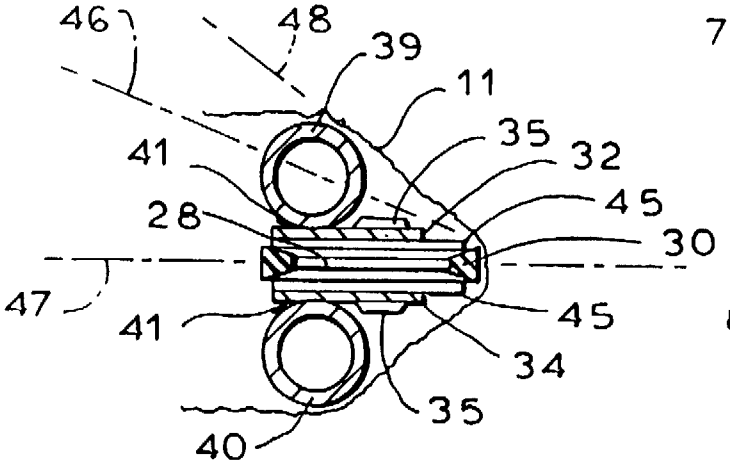
FIG. 4 is an enlarged cross sectional view as taken generally on line 4—4 of FIG. 3.

In accordance with one feature of the invention, and as illustrated in FIG. 4, the size and location of the tubular elements 39, 40 is such that fabric 11 engaged internally by the belt 30, and possibly also by upper and lower edges 45 of the guide rollers 28, is then next contacted by the smooth, generally rounded outer surface portions of the tubing sections 39, 40. The fabric is spaced from and makes no contact with outer lateral edge extremities of the sheet metal strips 33, 34. Likewise, the fabric is spaced from and makes no contact with the journal bolts 35, as the fabric passes over the exit-end of the spreader.

For purposes of description, it can be considered that a reference plane, drawn from the outermost edges of the sheet metal strips 33, 34, or the outer edges of the journalling bolts 35 (whichever represents the worst case condition) to the outermost edges 45 of the guide rollers 28 or the belt 30 (whichever represents the worst case condition) forms a predetermined reference angle with a horizontal processing plane defined by the entire spreader assembly. In FIG. 4, the first-described reference plane is identified by the reference numeral 46 and the processing plane by the reference numeral 47. A second reference plane 48 is defined by the path of the fabric from the tubular supports 39, 40 to the outermost edge of the belt 30 or guide roller 28. In this respect, if the belt 30 is deeply recessed within the guide roller 28, the fabric may contact the edge 45 of the guide roller when it passes over the vicinity of the guide roller. In the spaces between guide rollers, the fabric will necessarily extend from the edge of the belt 30 to the surface of the tubular elements 39, 41, as will be understood. For the purposes of the invention, it is significant that the angle between the second reference plane 48 and the processing plane 47 shall always be greater than in the angle between the first reference plane 46 and the processing plane, so that the moving fabric 11 remains free of contact with stationary edges. Momentary contact with the edges 45 of the guide rollers is not particularly detrimental, inasmuch as the guide rollers are in motion and there is thus no sliding or rubbing contact with the edges 45.

By locating the tubular elements 39, 40 laterally inside of the journalling bolts 35, as shown in FIG. 4, the angle between the reference plane 48 and the processing plane 47 is kept at a relative minimum, while nevertheless being larger than the angle with the first reference plane 46. This provides that the turning angle of the fabric over the outer surfaces of the tubular elements 39, 40 is minimized, so that pressure of the fabric on these surfaces is also minimized. Thus, while there is sliding contact between the fabric and surfaces of the tubing sections 39, 40, the pressure of such contact is widely distributed, and the surfaces contacted are of large radius, and the effect upon the fabric is thus minimal.

Although FIG. 4 is specifically a cross section taken of the exit section 14, the cross sectional geometry of the entry section 13 is the same in all essential respects.

In a preferred and illustrated form of the invention, the upper tubular sections 37, 39 of the entry and exit sections are joined by an integral bridging portion 50, and the corresponding lower tubular sections 38, 40 are joined by an integral bridging section 51. The bridging sections 50, 51 are contoured to substantially increase the thickness of the spreader frame in the center area, to accommodate the grooved belt-driving rollers 26, 27. The belt-driving rollers are of substantially cylindrical form, and have a height dimension which preferably is at least about two times the thickness of the spreader apparatus in the entry and exit sections thereof. The upper and lower corners of the belt-driving rollers are suitably rounded, as shown at 54 in FIG. 5.

Figure 2:
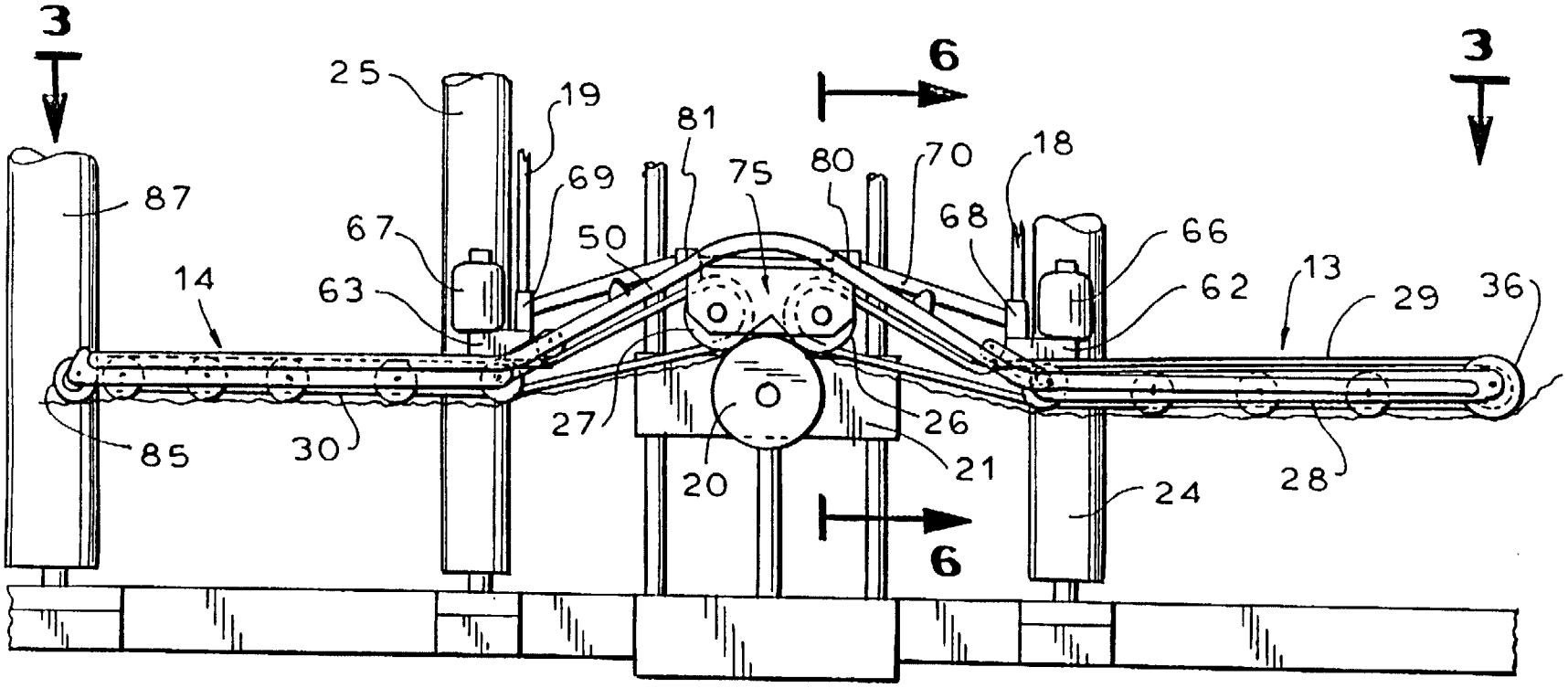
FIG. 2 is an enlarged view of one of a pair of spreader side frames constructed in accordance with the invention, viewed as installed in the processing line of FIG. 1.
Figure 3:
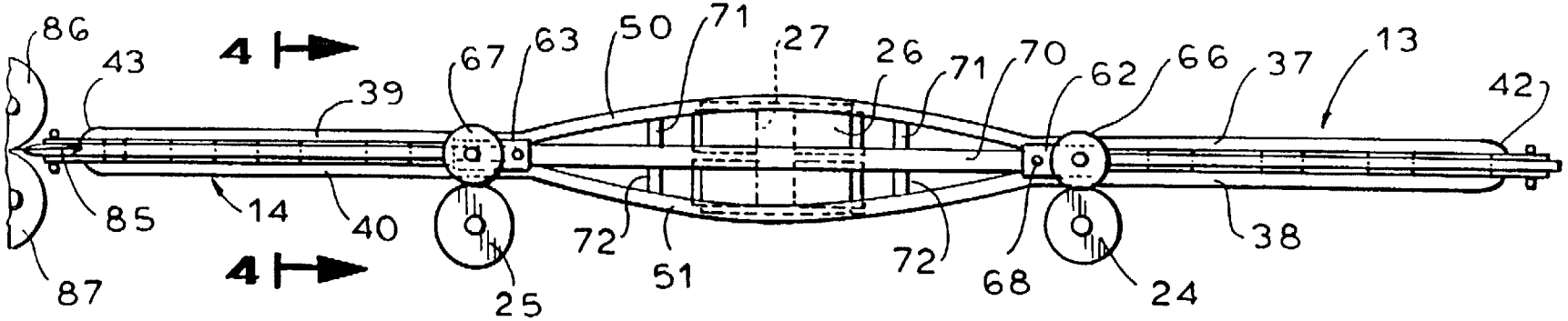
FIG. 3 is a side elevational view of the frame shown in FIG. 2, as viewed generally on line 3—3 of FIG. 2.

Because of the increased height of the spreader frame in the central area, it is desirable to provide for a compensating narrowing of the frame, so that the circumferential dimensions of the frame remain substantially constant. To this end, the tubular bridging portions 50, 51 are diverted inwardly, as shown in FIG. 2, as well as upwardly and downwardly, as shown in FIG. 3. Because the belt-driving rollers 26, 27 are offset inwardly from the guide rollers 28, redirection of the belts 29, 30 to the inwardly offset rollers 26, 27 is accomplished by means of guide rollers 58, 59. These are mounted on support arms 60, 61 respectively, which are resiliently biased to apply a desired level of tension to the respective belts.

Adjacent to the ends of the bridging sections 50, 51, the side frames are provided with mounting brackets 62, 63, which are welded rigidly to end portions of the tubular sections 37, 38 and 39, 40. The brackets 62, 63 mount shafts 64, 65, which in turn rotatably mount internal support rollers 66, 67. These internal support rollers are positioned to overlie the external support rollers 24, 25 (see FIG. 2) to provide support for the spreader frame and the fabric being processed thereon. The support rollers 66, 67, as well the underlying support rollers 24, 25 are formed of a somewhat resilient material, and the internal support rollers 66, 67 are of sufficient length to avoid the application of any crushing forces on the fabric passing underneath. In this respect, the spreader frame and fabric constitute a modest weight load, which is supported by two sets of the rollers 66, 67.

The mounting brackets 62, 63 also support sockets 68, 69, which are arranged to receive the spacer bars 18, 19 extending between spreader side frames at opposite sides.

Figure 5:
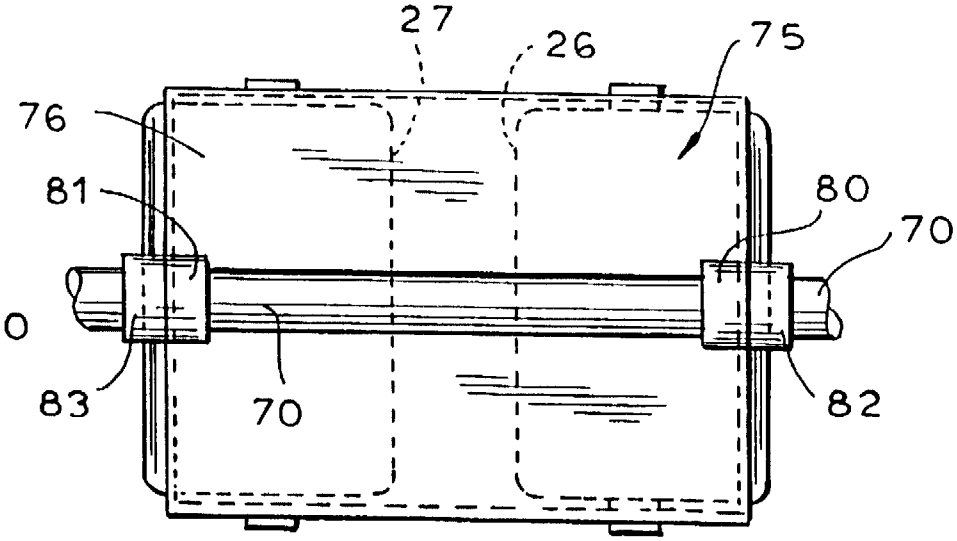
FIG. 5 is an enlarged fragmentary elevational view showing details of construction.

Additional strength and rigidity is added to the side frame sections by means of a tubular bridging strut 70 which is rigidly secured at its opposite ends to the sockets 68, 69. The bridging strut 70 preferably is arranged to lie at least partly inward from the upper and lower bridging sections 50, 51, as shown in FIG. 5, for example. Bracing struts 71, 72 extend from the bridging strut 70 to the respective bridging portions 50, 51 on each side of the belt-driving rollers, such that the bridging strut 70 and the bracing struts 71, 72 impart rigidity to the bridging sections 50, 51 in both vertical and horizontal directions.

As indicated in FIG. 2, the respective belt-driving rollers 26, 27 are mounted in slightly spaced relation and are arranged to be drivingly contacted, through a fabric wall, by externally driven edge drive rollers 20. Desirably, the edge drive rollers 20 are of cylindrical form (see FIG. 5) and are of such vertical dimensions as to extend both above and below the belt-driving rollers 26, 27. The arrangement is such as to distribute the contacting pressure between the edge drive roll 20 and the rollers 26, 27 over a large area, to minimize any effects upon the intervening wall of fabric 11. At least one, and preferably both of the edge drive rolls 20 and belt-driving rollers 26, 27 are formed of a somewhat resilient material to distribute compression forces over an increased area.

In a preferred form of the invention, the belt-driving rollers 26, 27 are mounted for limited pivoting movement about a horizontal axis, in order to assure perfect alignment with the edge drive rolls 20 and thus assure that pressure between the edge drive rolls and the belt-driving rollers is uniformly distributed from top to bottom. To this end, the belt-driving rollers of each frame structure are rotatably supported in a channel-like bracket 75 (FIGS. 5 and 6) of suitable sheet metal construction having an inner wall 76 and top and bottom walls 77, 78. The bracket 75 is open to the outside and rotatably mounts the belt-driving rollers 26, 27 by means of low profile bolts 79.

At opposite ends of the bracket back wall 76 there are welded or otherwise secured spaced bushings 80, 81, which are rotatably supported by center portions of the bridging strut 70, to accommodate limited pivoting movement of the entire bracket 75 and the belt-driving rollers 26, 27 about the horizontal axis of the bridging strut 70. Positioning collars 82, 83 are fixed to the bridging strut 70, in abutting relation to the collars 80, 81, to prevent any movement of the bracket 75 in a longitudinal direction, while accommodating limited pivotal movement.

Figure 6:
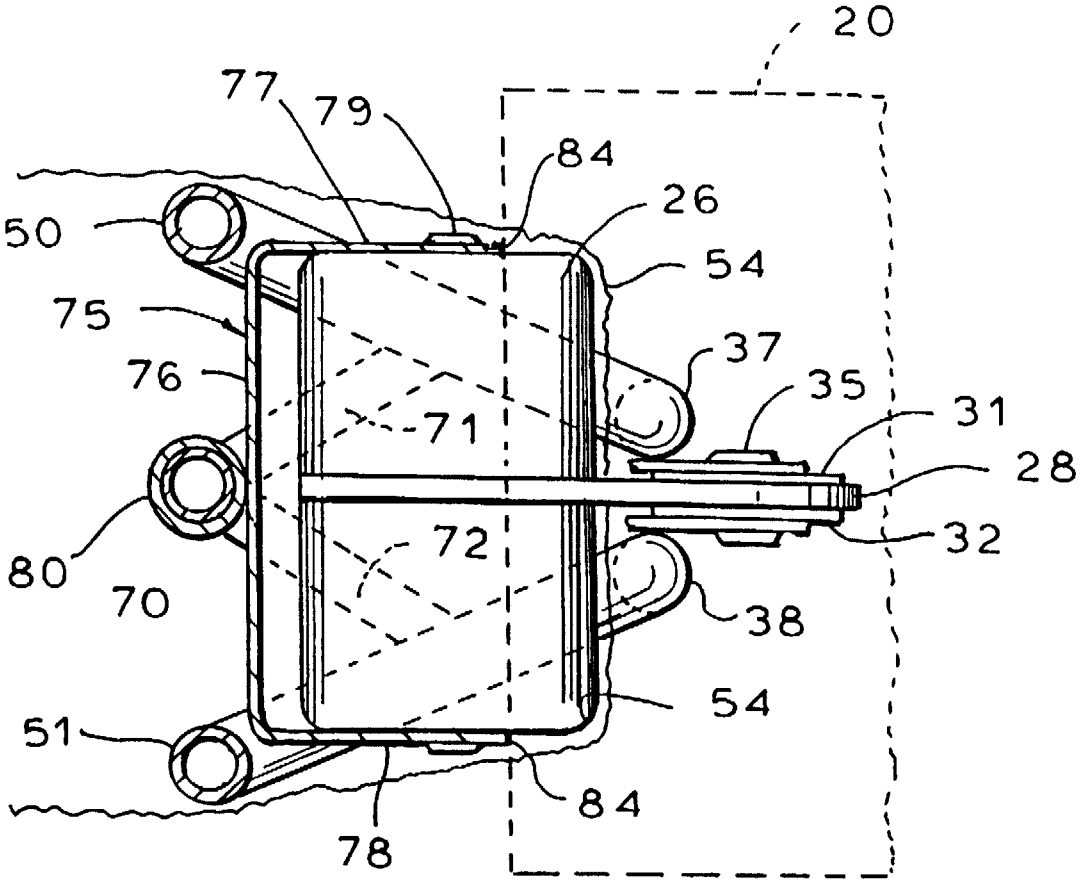
FIG. 6 is an enlarged cross sectional view as taken generally on line 6—6 of FIG. 2.
Figure 7:
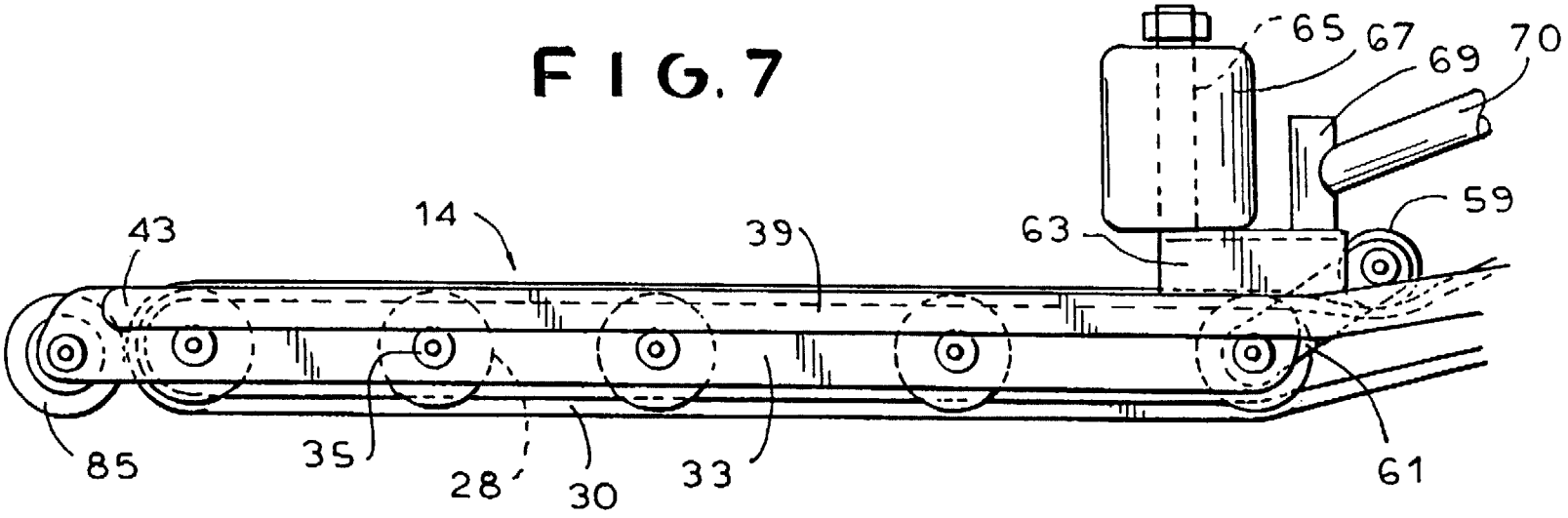
FIGS. 7 and 8 are enlarged, fragmentary top plan views showing exit end and entry end portions respectively of the frame apparatus of FIG. 2.
Figure 8:
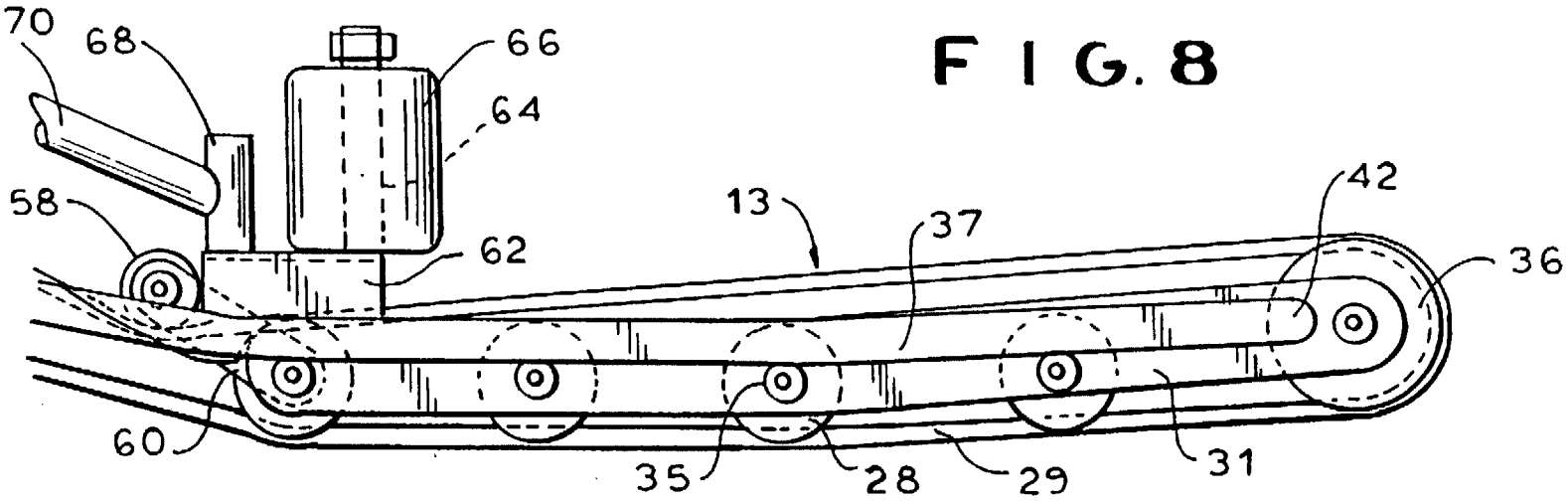

As shown in FIG. 6, the upper and lower walls 77, 78 of the mounting brackets 75 are located at a level well below the uppermost portions of the upper bridging section 50 and well above the lowermost portions of the lower bridging section 51, so that fabric extending from the rounded outer corner portions 54 of the rollers to the surfaces of the bridging sections 50, 51 passes in spaced relation over the outer edges 84 of the bracket walls 77, 78, and also over the outer edges of journal bolts 79 by which the rollers 26, 27 are mounted to the respective brackets 75. Although the specific geometry of the side frame is different in the region of the belt-driving rollers 26, 27, the geometric principles expressed with respect to FIG. 4 remain applicable.

In known spreader apparatus widely employed in the processing of tubular knitted fabrics, it is conventional to cause the fabric to exit over relatively thin sheet metal terminal portions which extend downstream of the last belt guide rollers. Such an arrangement, which is illustrated by way of example in U.S. Pat. No. 4,173,812, was sought to be desirable in order to carry the fabric at full width as far as possible into a subsequent roller nip or the like in which the fabric was to be engaged. However, the present invention recognizes that such a feature, by providing stationary edges over which the fabric is moving longitudinally under circumferential tension, constitutes a source of marking of the fabric. The apparatus of the present invention, incorporates instead tapered, non-driven guide rollers 85 at the discharge end of the exit section 14. The guide rollers 85 are freely rotating, and preferably are mounted to have portions exposed both laterally outward of and downstream of the sheet metal strips 33, 34, as shown particularly in FIG. 7, for example. The tapered guide roller 85 may be projected partially between a pair of nip rollers 86, 87 (FIG. 3), so that positive control over the fabric is maintained as long as practicable. Although the tapered end rollers 85 may not permit projection of the exit end of the spreader as far into the roller nip as with presently known devices, this is more than compensated for by the fact that the fabric is not subjected to marking conditions, as it is discharged from the spreader.

The new spreader apparatus, has outstanding functional advantages in being able to process delicate tubular knitted fabrics as free as possible of marking, which can result from causing the fabric to pass over stationary edges. In large part this advantage is achieved by incorporating into the spreader frame a plurality of relatively large diameter tubular sections, which guide the fabric directly from moving conveying elements to smooth, generously rounded surfaces of the tubing, diverting the fabric away from any sharp edges of related sheet metal structure. At the same time, the tubular elements add significantly to the structural integrity of the spreader frame, so that damage and down-time are significantly reduced.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. In a spreader-propeller apparatus for processing tubular knitted fabric and of the type comprising a pair of spreader side frames, spacer means for retaining said side frames in predetermined spaced apart relation, each said side frame comprising an entry section and an exit section, each said section mounting a plurality of grooved guide rollers and fabric driving belts trained in said guide rollers and exposed for internal engagement with the walls of tubular knitted fabric configured in generally flat, two-layer form, and a pair of internal belt-driving rollers in a mid portion of each said side frame arranged to be engaged through a fabric wall by external, controllably driven edge drive rolls, the improvement characterized by (a) each of said frame sections comprising a pair of elongated, generally flat sheet metal strips extending generally in a longitudinal direction and mounting between them a plurality of said grooved guide rollers for rotation about axes disposed generally at right angles to a processing plane defined, by said side frames, (b) said frame sections having generally longitudinally extending outer lateral edges, and portions of said grooved guide rollers extending laterally outward beyond said outer lateral edges, (c) first reference planes extending from upper and lower portions of said belts and guide rollers and in contacting relation to the outer lateral edges of said sheet metal frame sections forming first reference angles with said processing plane, (d) upper and lower tubular elements rigidly secured to the upper and lower surfaces respectively of said frame sections and spaced inwardly from the outer lateral edges thereof, (e) said tubular elements being of a diameter which is a large multiple of the thickness of said sheet metal frame sections, and (f) second reference planes extending from upper and lower portions of said belts and in tangential relation to outer surfaces of said tubular elements forming second reference angles with said processing plane which are greater than said first reference angles, whereby fabric passing over said spreader and guided at its edge portions along a path defined by said second reference angles is maintained free of moving contact with said outer lateral edges.

2. An apparatus according to claim 1, wherein (a) the entry and exit sections of each said side frame are spaced apart longitudinally, and (b) said tubular elements extend continuously from said entry sections to said exit sections, and include portions bridging the space between said sections to form rigid side frame structures.

3. An apparatus according to claim 2, wherein (a) each of said side frame structures mount closely spaced entry-side and exit side belt-driving rollers for rotation about spaced axes generally perpendicular to said processing plane, and (b) roller mounting means for said belt-driving rollers are carried by said frame structures and extend laterally outward to center portions of said rollers, (c) said bridging portions of said upper and lower tubular elements having surface portions lying respectively above and below upper and lower ends of said belt-driving rollers, whereby reference planes contacting upper and lower outer portions of said belt-driving rollers and tangent to outer surface portions of said bridging portions are spaced from said roller mounting means, whereby fabric passing over said belt-driving rollers and contacting said bridging portion is maintained free of contact with said roller mounting means.

4. An apparatus according to claim 3, wherein (a) said belt-driving rollers are of substantially cylindrical form and have a height which is a multiple of at least about two of the height of said entry and exit sections including the tubular elements mounted thereon, (b) the bridging portions of said upper and lower tubular elements being directed angularly upwardly and downwardly respectively in transition regions between said entry and exit frame sections and said belt-driving rollers, such that said spreader side frames are of substantially increased thickness in the region of said belt driving rollers, (c) said bridging portions of said tubular elements being further directed angularly inwardly in said transition regions.

5. An apparatus according to claim 4, wherein (a) said edge drive rolls are of substantially cylindrical form and of greater height than said belt-driving rollers so as to have portions extending above and below said belt-driving rollers when said spreader frame is positioned in operating relation to said edge drive rolls, (b) entry-side and exit-side external support rollers extend transversely across said apparatus on opposite sides of said edge drive rolls, and (c) each said spreader side frame mounts a entry-side and exit-side internal positioning rollers extending transversely inward therefrom and adapted to overlie said external support rollers.

6. An apparatus according to claim 5, wherein (a) said roller mounting means comprise channel-like brackets pivotally mounted on said frame structures for limited pivoting movement about horizontal axes.

7. An apparatus according to claim 6, wherein (a) said frame structures include a bridging strut extending between entry-side and exit side frame sections in bridging relation thereto, (b) said bridging struts being disposed generally laterally inside of said belt-driving rollers and vertically intermediate the bridging portions of said upper and lower tubular elements, and (c) said channel-like roller mounting brackets are mounted on said bridging struts for limited pivoting movement in relation thereto.

8. An apparatus according to claim 1, wherein (a) each of said exit side frame sections mounts, at an exit end extremity thereof, and closely adjacent to the endmost one of the grooved guide rollers carried by said exit side section, a tapered guide roller having portions exposed laterally outward of said frame section and longitudinally beyond said end extremity, and (b) said tapered guide rollers are so positioned in said frame sections that the laterally exposed portions of said tapered rollers form a substantial continuation of the path of a fabric edge passing over said apparatus and being discharged from the exit end thereof.

9. An apparatus according to claim 1, wherein (a) said guide rollers are mounted for rotation about axes disposed at right angles to said processing plane, and (b) said guide roller axes are located laterally outward of said upper and lower tubular elements.

10. An apparatus according to claim 9, wherein (a) said guide rollers are mounted for rotation between said flat sheet metal strips by bolts extending through said strips and accessible from above and below said frame sections, and (b) said bolts are located entirely within the space defined between said processing plane and said second reference planes, whereby fabric passing over said frame sections is maintained free of contact with said bolts.

11. An apparatus according to claim 2, wherein (a) a bridging strut extends between said entry-side and exit-side frame sections in bridging relation thereto, (b) said bridging strut being disposed generally laterally inside of bridging portions of said upper and lower tubular elements and at a level between said upper and lower tubular elements, and (c) one or more bracing strut elements extend from said bridging strut to bridging portions of said upper and lower tubular elements.

12. An apparatus according to claim 11, wherein (a) said bridging strut and said bracing strut elements are formed of tubular material.

13. An apparatus according to claim 11, wherein (a) said belt-driving rollers are mounted for limited pivoting movement with respect to said bridging strut to assure proper alignment with respect to said edge drive rolls.

14. In a spreader-propeller apparatus for processing tubular knitted fabric and of the type comprising a pair of spreader side frames, spacer means for retaining said side frames in predetermined spaced apart relation, each said side frame comprising an entry section and an exit section, each said section mounting a plurality of grooved guide rollers and fabric driving belts trained in said guide rollers and exposed for internal engagement with the walls of tubular knitted fabric configured in generally flat, two-layer form, and a pair of internal belt-driving rollers in a mid portion of each said side frame arranged to be engaged through a fabric wall by external, controllably driven edge drive rolls, the improvement characterized by (a) said belt-driving rollers and said edge drive rolls having axial height dimensions substantially greater than vertical height dimensions of said entry and exit sections, and (b) means mounting one of said belt-driving rollers or said edge drive rollers for limited pivoting movement about an axis at right angles to axes of rotation thereof, whereby said belt-driving rollers will contact said edge drive rolls with uniform pressure.

* * * * *